United States Patent [19]

Overy

[11] 4,266,376

[45] May 12, 1981

[54] PORTABLE ELECTRICALLY ENERGIZED SURFACE FINISHING TOOL

[75] Inventor: Colin Overy, Brockville, Canada

[73] Assignee: Black & Decker Inc., Newark, Del.

[21] Appl. No.: 10,912

[22] Filed: Feb. 9, 1979

[51] Int. Cl.[3] ..... B24B 23/00

[52] U.S. Cl. ..... 51/170 R; 15/23

[58] Field of Search ..... 51/170 R, 170 PT, 170 T; 15/23, 24

[56] References Cited

U.S. PATENT DOCUMENTS

| | | | |
|---|---|---|---|
| 1,816,054 | 7/1931 | Pelkey | 15/23 |
| 2,750,610 | 6/1956 | Bloch | 15/23 |
| 2,973,576 | 3/1961 | Hentke | 51/170 PT |
| 3,251,085 | 5/1966 | Jacobs | 15/23 |
| 3,307,211 | 3/1967 | Gaines | 15/23 |
| 3,368,635 | 2/1968 | Harman | 15/23 |
| 3,550,324 | 12/1970 | Gerry | 51/170 T |

*Primary Examiner*—Roscoe V. Parker

*Attorney, Agent, or Firm*—Leonard Bloom; Edward D. Murphy; Harold Weinstein

[57] ABSTRACT

An improved, portable, electrically energized surface finishing tool for use with peripherally acting finishing devices and for use with planar finishing devices is disclosed.

21 Claims, 13 Drawing Figures

48
50
64
212
200
154
28
54
30
126
55
22
62
70
84
90
92
96
60
56
58
190
110
146
148
34
116
114
32
164
162
152
150
26
183
186
174
180
176
178
181
197
172
195
44
161
170
157
155
38

7
80
6
92
66
68
30
88
124
178
174
186
180
188
122
126
84
70
72
86
74
78
76
96
94
6
188
38
182
179
181
176
128
90
110
82
20
7
54
34
112
62
24
29
10
172
157
132
134
130
164
159
22
192
22
155
56
8
163
148
140
133
154
155
133
142
144
113
114
166
32
146
116
151
140
148
58
8
165
138
162
10
158
198
152
202
200
26
28
42

PORTABLE ELECTRICALLY ENERGIZED SURFACE FINISHING TOOL

BACKGROUND OF THE INVENTION

1. Field of the Invention

This invention relates to surface finishing tools. The invention relates more particularly to an improved, portable hand held electriclly energized surface finishing tool.

2. Description of the Prior Art

Among the various surface finishing operations, those typically performed by tradesmen, craftsmen, and homeowners include rotary finishing with peripherally acting finishing devices, such as wire wheel brushes, flexible flap sanding wheels, flexible drum sanders, and cotton buffing wheels. Surface finishing is also practiced utilizing, for example, sanding discs and polishing bonnets. In the latter case, a relatively larger rotary surface performs the finishing.

These finishing devices have in the past been mounted on an output spindle of a stationary drive, or alternatively, they have been rendered portable as accessory devices for mounting in a portable, electric, power drill chuck or in a portable finishing tool. The drill mounted accessories have exhibited various deficiencies including poor handling performance since the use of the accessory is auxiliary to the principal design for axial drilling with a mounted drill bit chuck. Overall handling of the tool is relatively poor because of a relatively large overhang of the accessory device with respect to the axis of the drill chuck. The resultant forces acting on the user have a tendency to fatique the user. From a performance viewpoint, the finishing characteristics are relatively poor since the speed-torque characteristic of the device is not particularly selected to satisfactorily power a variety of surface finishing devices. Moreover, the use of these auxiliary devices with electric drills is done in the absence of safety guards. Some portable power tools have been designed to provide for sanding or for polishing but such tools, which are dedicated to finishing in a plane, provide a direct drive which increases the weight and cost of the finishing tool. Some of these deficiencies can be corrected by mounting the device on a stationary motor but the application is then limited to those jobs which can be hand held.

SUMMARY OF THE INVENTION

Accordingly, it is an object of this invention to provide an improved portable, hand held electrically powered, surface finishing tool.

Another object of the invention is to provide an improved surface finishing tool which is adapted for finishing with peripheral type finishing devices.

Another object of the invention is to provide a surface finishing tool adapted to surface finishing alternatively with peripheral or planar finishing devices.

A further object of the invention is to provide an improved multi-purpose finishing tool adapted to be handled with ease by the user and which reduces fatigue during use.

A further object of the invention is to provide a multi-purpose finishing tool having a safety guard for use with peripheral acting finishing devices.

Another object of the invention is to provide an improved portable tool which provides an enhanced reduction in noise level, ease of handling, and reduced cost of fabrication.

In accordance with features of this invention, an improved, portable, electrically energized surface finishing tool which is adapted to be hand held by a user comprises an elongated tool body having a length and distal first and second opposite ends. A tool support handle is positioned adjacent a first end of the tool and a support spindle which is adapted to receive a peripherally acting surface finishing tool is positioned adjacent the second opposite end of the tool. The support handle and the spindle are mutually orientated for providing that the spindle extends horizontally and transversely to the tool body length when the support handle is positioned vertically. A guard means is positioned between the spindle and the support handle and is configured to inhibit the projection of particles from the second relatively forward end of the tool body to the first relatively rearward end at which position a user is located. Ease of use and balance is imparted to the tool by positioning an electric drive motor armature shaft at a location intermediate the first and second ends and extending from a side of the tool opposite to the side from which the spindle extends. The armature shaft extends transversely with respect to the length of the tool.

In accordance with more particular features of the invention, the tool body comprises an elongated frame member and first and second housing members which enclose a portion of the frame member. A means is provided for rotatably mounting the spindle to the frame member at the second end thereof and for mounting the electric motor to the frame member at a position intermediate the first and second ends. The housing members are intercoupled and mounted to the frame member and form a saw grip support handle at the first end of the tool. A second hand gripping means is also provided and it positioned near the first end of the tool and extends in a transverse direction with respect to the length of the tool at a location opposite the spindle. A means including a belt drive is provided for coupling rotary motion from the armature shaft to the spindle. An adjustable spindle bearing block is also provided for adjusting the tension of the drive belt.

BRIEF DESCRIPTION OF THE DRAWINGS

These and other objects and features of the invention will become apparent with reference to the following specification and to the drawings wherein.

DETAILED DESCRIPTION

Figure 1:
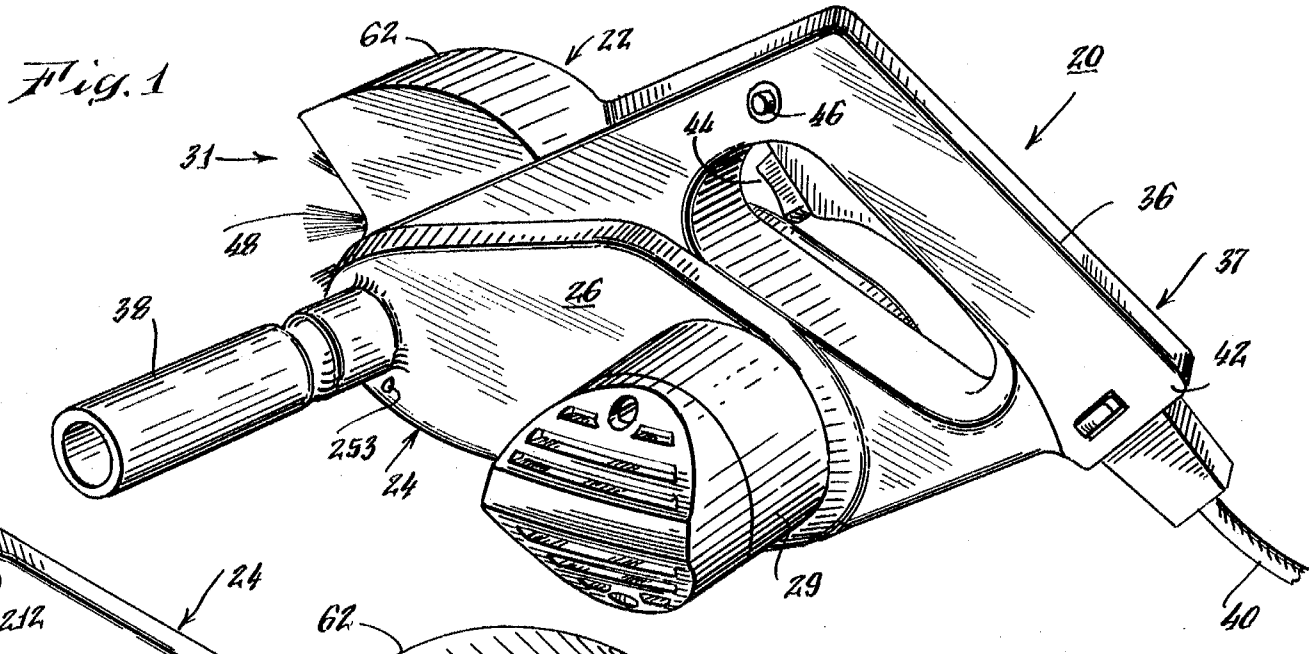
FIG. 1 is a left hand perspective view of the surface finishing tool of this invention.
Figure 2:
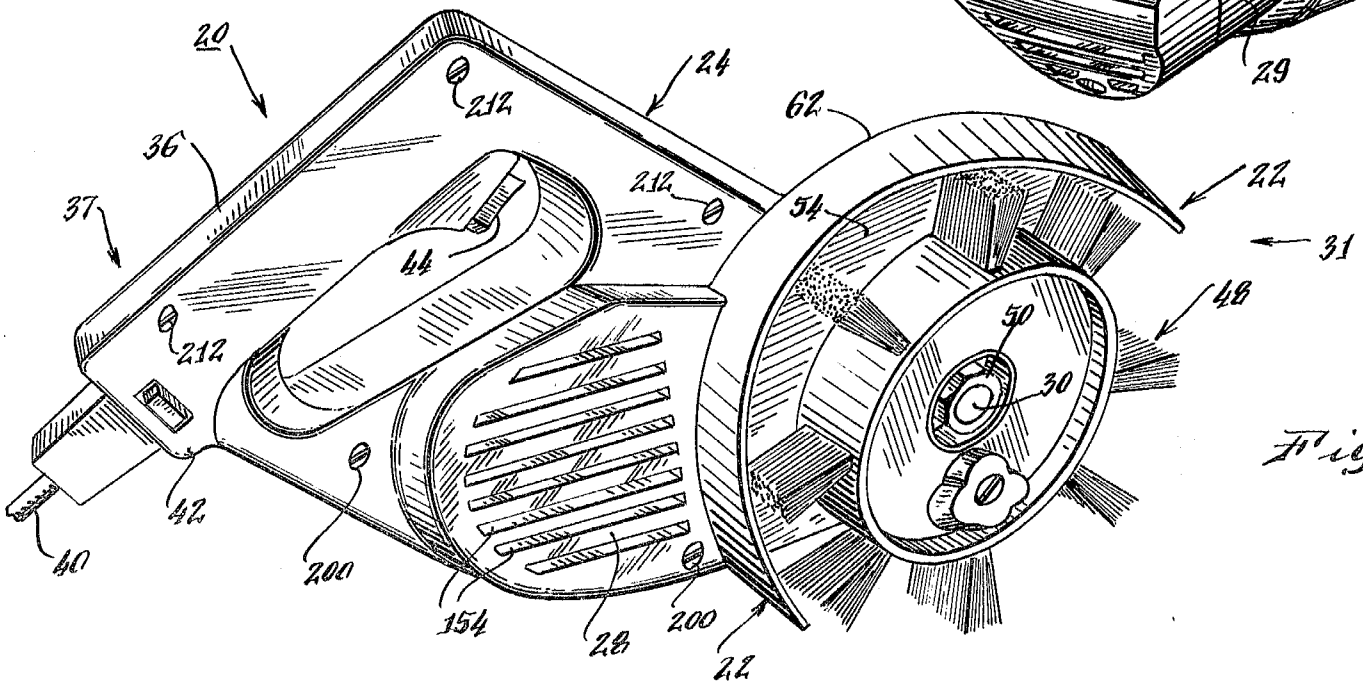
FIG. 2 is a right hand perspective of the finishing tool of FIG. 1.
Figure 3:
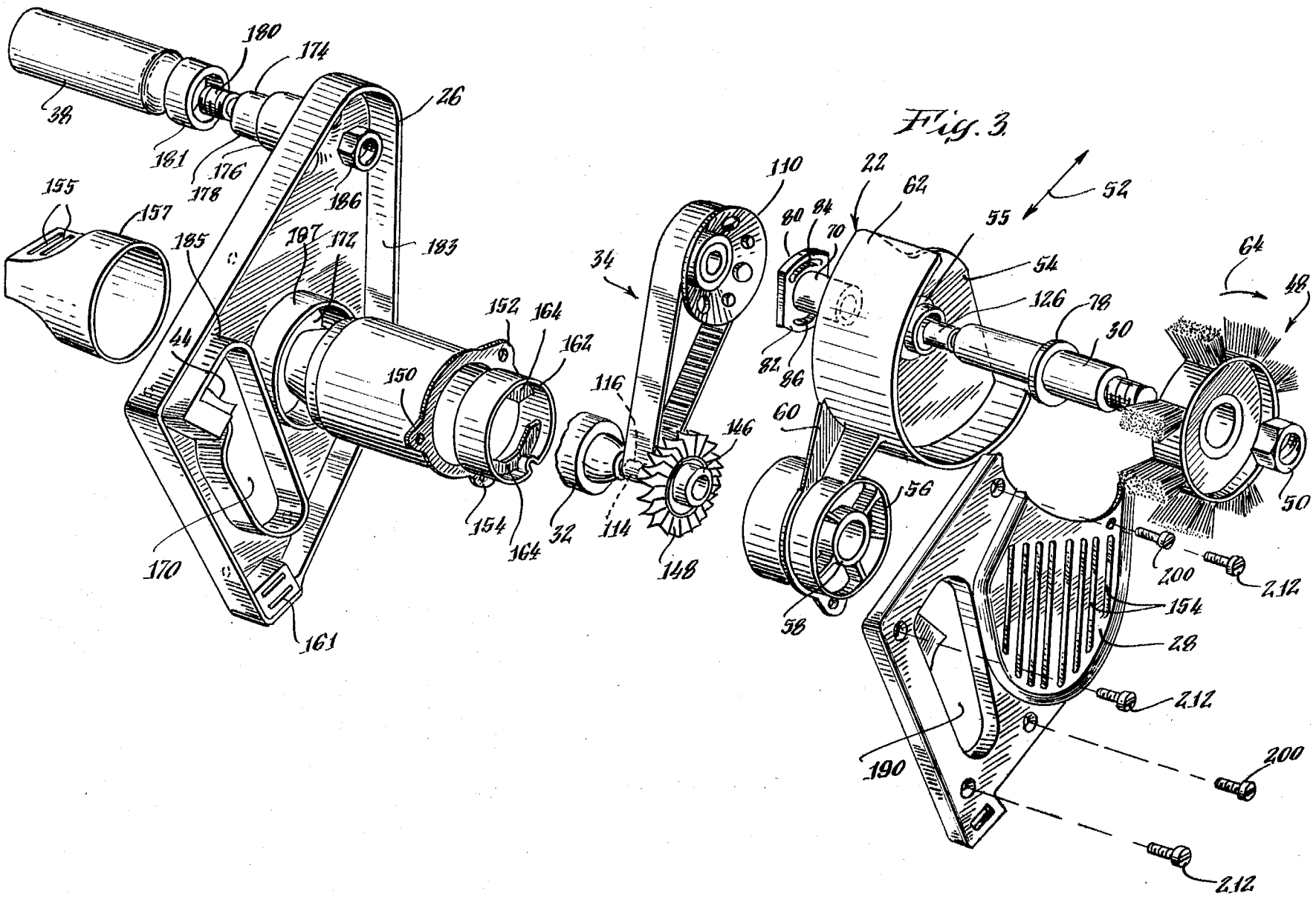
FIG. 3 is an exploded perspective view of the finishing tool of FIG. 1.

Referring now to the drawings and particularly to FIGS. 1, 2 and 3, the hand/held portable, electrically energized surface finishing tool body 20 is shown. The tool body is enlongated having a handle gripping segment 36 at a first end 37 thereof and a spindle 30 at a second, relatively forward end 31 thereof. The tool includes an elongated frame member 22 (FIG. 3), a housing 24 formed by housing members 26 and 28, the tool spindle 30 which is rotably mounted to the frame member 22, an electric drive motor 29 having an armature 32 and a coupling means referenced generally as 34 for imparting rotary motion from the motor armature 32 to the spindle 30. The finishing tool 20 is conveniently gripped with one hand at the saw gripped shaped handle segment 36 and at a tubular shaped relatively forward positioned gripping member 38 with the other hand. Electrical energy is applied to the finishing tool via a line cord 40 which is coupled to the base 42 of the saw grip section 36. Electrical energy is applied to the motor by a finger activated trigger control switch 44. Electrical power is continuously applied and the switch 44 retained in a retracted position by a lock button 46.

A rotary peripherally acting device 48 is mounted to the drive spindle 30 and is secured thereto by a retaining nut 50. The tool 20 is particularly useful with finishing devices which provide a finishing operation at an edge or near a periphery of the accessory such as the sanding flap wheel 48 illustrated in the drawings as well as by wire brush wheels, buffing wheel, sanding drums, etc. A particular form of sanding flap wheel is described in greater detail in copending U.S. patent application Ser. No. 010,911, now U.S. Pat. No. 4,251,958 filed concurrently herewith, and which is assigned to the assignee of this invention. As illustrated in the drawings, the flap wheel includes a generally cylindrically shaped housing from which a plurality of radially extending flexible abrasive strips backed by a resilient support means is provided. A guard means 62 is provided positioned between the spindle 30 and handle 36 for inhibiting projection of particles and protecting the rearwardly positioned user from materials which may be deflected as a result of the finishing operation. The particular arrangement of the rotary accessory, the drive motor, the hand grip means and the guard provide for a convenient and easily handled and balanced tool which provides edge finishing or alternatively, surface finishing as described hereinafter with respect to the FIGS. 12 and 13.

The frame support member 22 is an elongated body extending in a direction 52 (FIG. 3) and is adapted to support at first and second spaced apart locations, the transversely extending tool spindle 30 and the transversely extending motor armature 32. Frame support member 22 includes a generally planar shaped spindle support segment 54 having an aperture 55 formed therein and through which the spindle 30 extends and is supported by a bushing as described hereinafter. A motor bearing support segment 56 of the member 22 is provided having a generally spider shaped segment 58 for receiving and supporting a bearing for the armature shaft of the armature 32. The motor bearing support segment of the frame member 22 and tool support segment 54 are intercoupled by a longitudially extending ribbed coupling segment 60. A guard member or shroud 62 comprises an arcuate segment which extends transversely to the length of the frame member 22 and extends for an arcuate distance about the spindle 30 for shielding the user from particles and material which are projected by the finishing device 48 which rotates in the clockwise direction 64 as illustrated in FIG. 3.

Disc shaped mounting pads 63 and 65 (FIG. 4) are formed integrally with the frame 22 and provide for stationary mounting of the tool 20. The pads 63 and 65 abut generally rectangular shaped bosses 67 and 69 which receive nuts 71 and 73, respectively. Apertures 75 and 77 formed respectively in the pads 63 and 65 align with the nuts 71 and 73. The housing member 28 along with the bosses 67 and 69 and the pads 63 and 65 captivate the nuts 71 and 73. These nuts receive and engage mounting screws 79 and 81 which engage and mount the tool to a mounting means, not illustrated. A mounting means which comprises a bracket for example supports the tool 20 and mounts it to a work bench, a vice grip jaw, or other desired support. The weight of the finishing tool 20 is kept low and its use facilitated by fabricating the frame member 22 of a durable lightweight rigid material. In a particular embodiment, the frame member 22 is formed of aluminum and the spindle support segment 54, the motor bearing support segment 56, the guard segment 62 and the longitudinally extending ribbed coupling segment 60 are integrally formed.

Figures 4, 7:
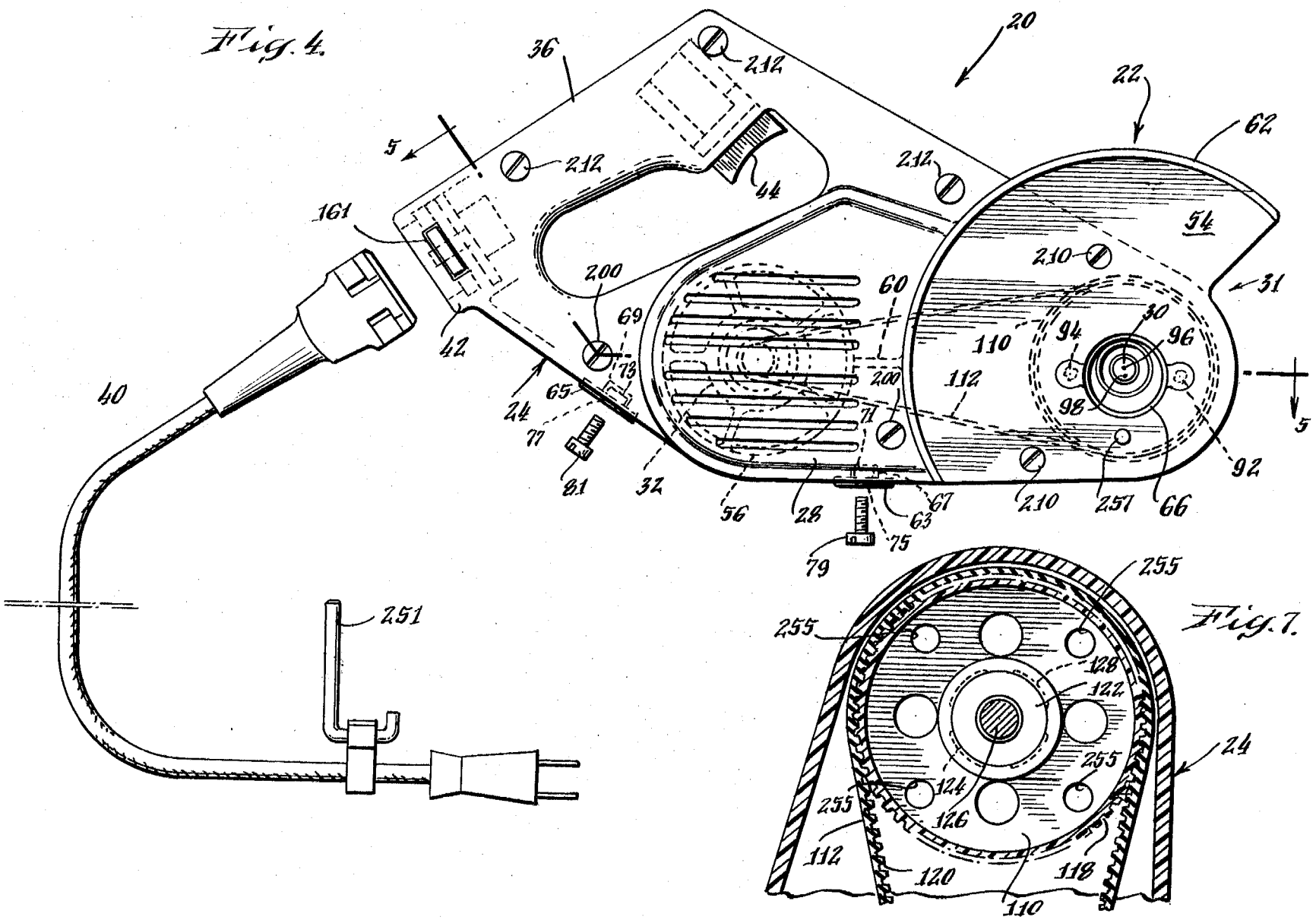
FIG. 4 is a side elevation view of the finishing tool of FIG. 1.
FIG. 7 is a view taken along the line 7—7 of FIG. 5.
Figure 5:
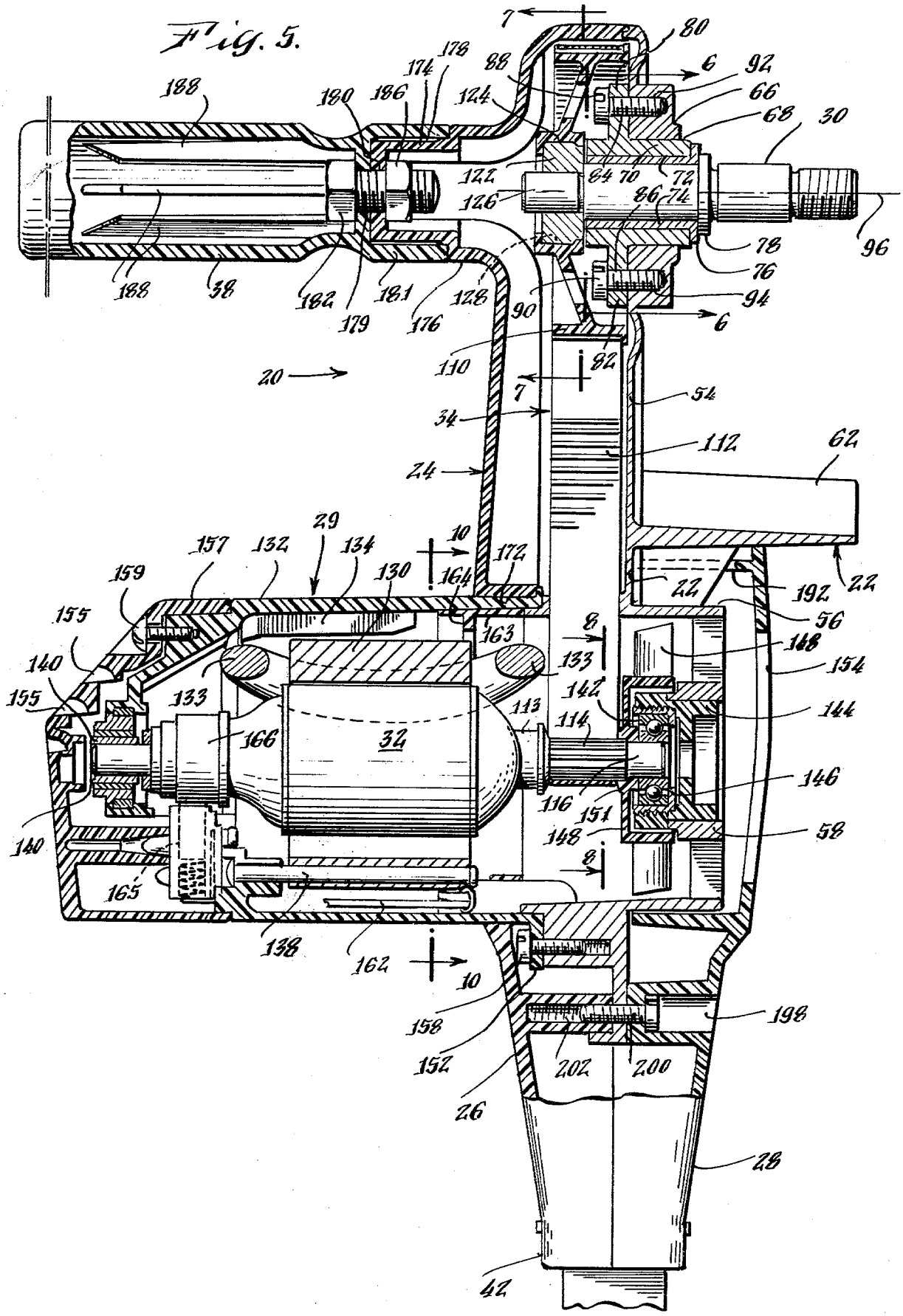
FIG. 5 is a sectional view taken along line 5—5 of FIG. 4.
Figure 6:
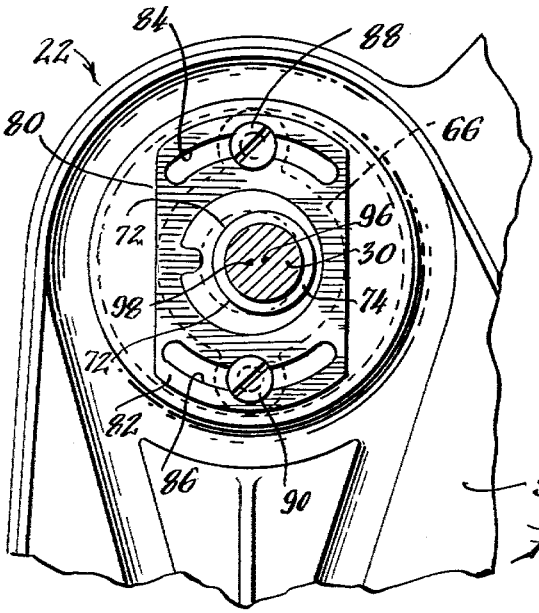
FIG. 6 is an enlarged view of an eccentrically mounted spindle taken along the line of 6—6 of FIG. 5.

Mounting and support of the tool spindle 30 is illustrated in FIGS. 5, 6 and 7. As shown in FIG. 5, the spindle support segment 54 includes a raised hub 66 having a bore 68 formed therein. A bearing block 70 having a bore 72 formed therein is positioned in the aperture 68. The block supports a bearing such as a bushing 74 formed of bronze, for example, which is seated in the bore 72. The bushing 74 receives a segment of the tool spindle 30. A lip 76 of the bushing engages a flange shoulder 78 formed on the spindle thereby limiting axial movement of the spindle and provides a thrust bearing for planar type devices. The bearing block 70 includes shoulders 80 and 82 (FIG. 6) each having arcuate formed slots 84 and 86 respectively formed therein. The bearing block is secured to the spindle support segment 54 by screws 88 and 90 which extend through the slots 84 and 86 respectively and engage internally threaded bores 92 and 94 formed in the hub 66. As illustrated in FIG. 6, an axis 96 of the spindle 30 and its bushing 74 and bore 72 are eccentrically located with respect to a central axis 98 of the bearing block 70. This eccentricity is established by forming the bore 72 in the bearing block having an axis coinciding with the axis of the bushing and the spindle 30 and eccentric with the central axis 98 of the bearing block 70. As indicated hereinafter, the bearing block is adjusted to provide belt tensioning of a drive means. Adjustment is affected by loosening the screw 88 and 90 and rotating the bearing block until desired tension is established.

Figure 11:
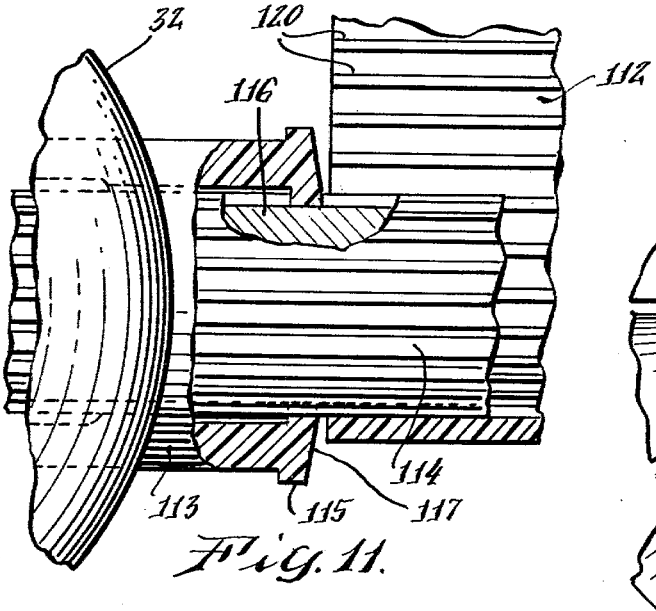
FIG. 11 is an enlarged fragmentary, partly broken away, partly in section, view of the drive belt and armature shaft of FIG. 5.

A drive means for coupling rotary energy from the armature 32 of the electric motor includes a drive pulley 110 formed of a polymer plastic for example, a toothed drive timing belt 112, and drive teeth 114 formed in the armature drive shaft 116 (FIG. 11). The pulley 110 includes (FIG. 7) a toothed outer periphery 118 which engages drive teeth 120 on the timing belt 112. A hub 122 is positioned in a centrally located cavity 124 on the pulley 110. The hub 122 which is press fitted to a segment 126 of the spindle 30 includes a plurality of radially extending, peripheral arc shaped segments 128 which extend into the body of the pulley and transmit torque. The hub is formed of metal and is integrally formed with the pulley.

The motor 29 includes the rotatable armature 32 and a stationary field assembly including a magnetic core 130 and field windings 133. The core 130 is centrally located within a generally cylindrically shaped field case 132 by radially extending shoulders 134 and is secured in position by elongated rivets 136 and 138 which extend through the field core 130. The armature shaft 116 is supported at one end by a bushing 140 which is captivated at one end of the field case 132. An opposite end of the armature shaft 116 is supported by a ball bearing assembly 142. The ball bearing assembly 142 is positioned and seated in an electrically insulating bearing support 144, which is seated in the centrally located spider shaped segment 58 of the motor bearing support segment 56 of frame assembly 22. A cup shaped body 146 formed of rubber, for example, is positioned between the ball bearing assembly 142 and the ball bearing support 144 for vibration dampening and to take up manufacturing tolerances.

Figure 8:
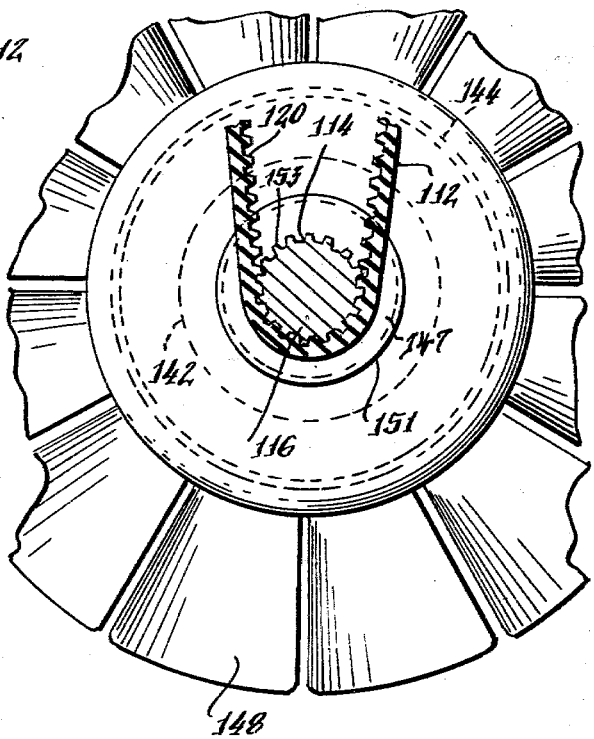
FIG. 8 is an enlarged view of a motor cooling fan and armature shaft taken along the line 8—8 of FIG. 5.
Figure 10:
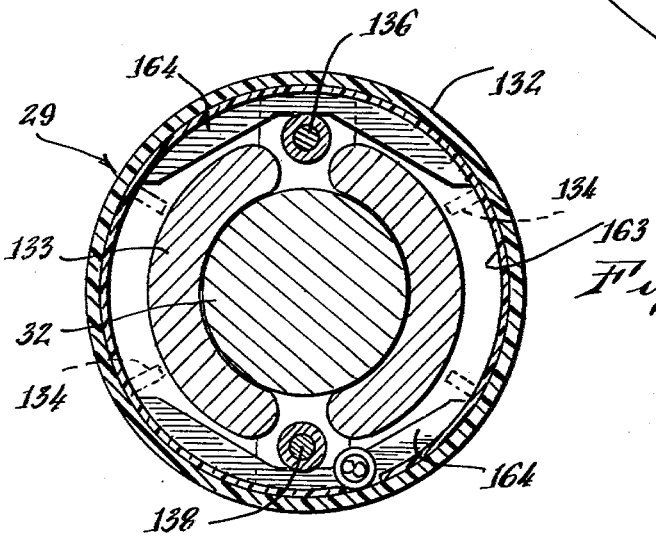
FIG. 10 is a sectional view taken along line 10—10 of FIG. 5.
Figure 9:
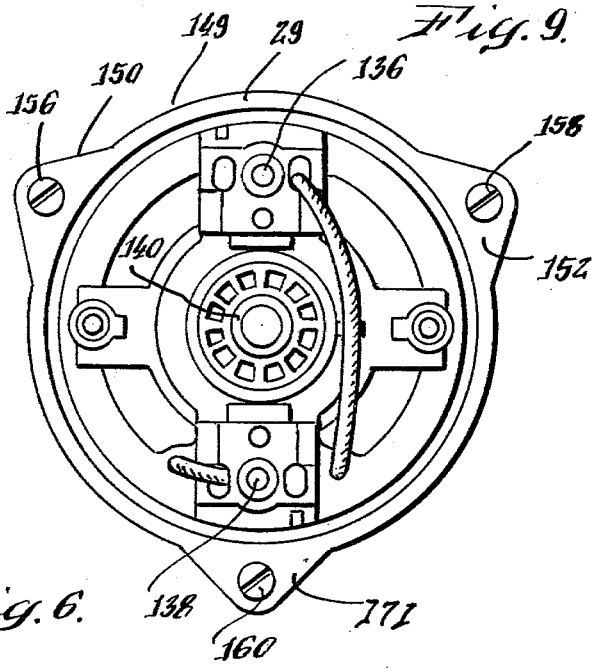
FIG. 9 is a view taken along lines 9—9 of FIG. 5.

The armature 32 requires a predetermined length of insulation extending from the armature core to accommodate end turn segments of the armature winding at the end of the armature core. In addition, the armature shaft 116 is cut to provide teeth 114 which engage the belt 112. The cutting of such teeth generally requires additional, non-useful shaft length in order to provide for runout of the teeth cutting tool. Further, toothed belts 112 require an adjacent, rotating, beveled surface. These various requirements are met and the shaft length is advantageously minimized by the use of a molded plastic insulating sleeve 113 having a shoulder 115 (FIG. 11) with a beveled surface 117. An inner bore of the sleeve 113 at the shoulder 115 extends over the runout and the shoulder collar is toothed to engage the armature shaft teeth 114 for causing rotation of the sleeve 113 therewith. The fan 148 described hereinafter also includes a similarly beveled surface 147 (FIG. 8). The electric motor assembly 29 which is positioned in the field case 132 is mounted to the frame member 22 with a longitudinal axis of the armature 32 extending in a direction transverse to the length of the frame member 22. The field case, which as indicated, is generally cylindrically shaped includes a ring 149 (FIG. 9) having radially extending ears 150 frame member 22 thereby securely mounting the field case and the motor assembly positioned therein to the frame member 22.

Electrical energy is applied to the armature 32 from the line cord 40 which engages a plug 161 mounted in the handle of the housing. Electrical leads, not illustrated, extend from this plug to the trigger control switch 44 and from the trigger switch 44 to the field case 132. Electrical leads 162 in the field case are coupled to spring biased brushes 165 for applying electrical energy to a commutator 166 of the armature upon actuation of the trigger switch 44.

A means for cooling the motor 29 includes the fan 148 which is mounted to the armature shaft 116 for rotation therewith. As best seen in FIGS. 5 and 8, fan 148 includes a central hub segment 151 having internally formed teeth 153.

The hub segment is positioned on a toothed segment of the armature shaft 116 and the teeth 153 are positioned in engagement therewith for causing rotation of the fan upon rotation of the shaft. Cooling of the motor is effected by rotation of the fan 148 which establishes an air stream flowing through slotted apertures 155 (FIG. 5) formed in a cap 157 which is mounted to the field case 132 by screws 159, over the motor field core and winding 130 and 133, over the armature 32 and through apertures 154 in the housing member 28. A means is provided for increasing the flow over the outer surface of the armature 32 in order to enhance the cooling of the armature. This means comprises a cylindrically shaped baffle 163 which extends into the field case 132 from a location adjacent the field frame 22. The baffle includes a plurality of radially extending segments 164 which increase the resistance of air flow over the outer portions of the winding and increase the flow of cooling air between the armature and the core 130 thus enhancing cooling of the armature.

The housing member 26 (FIG. 3) includes a gripping aperture 170 formed therein, a motor aperture 172, a post segment 174 and a transversely extending flange 183 extending about the periphery of this housing member. The gripping aperture 170 includes a transversely extending integrally formed flange segment 185. A transversely extending, cylindrically shaped motor flange segment 187 extends about the motor aperture 172. The switch 44 and the electrical power plug 161 are supported by ribs not illustrated in detail.

The hand gripping post segment 174 includes a shoulder segment 176 and a segment 178 of reduced diameter in which an aperture 180 is formed. The tubular gripping handle 38 includes a segment 181 which engages the segment 178. A bolt 182 extends through the aperture in the handle 38 and through the aperture 180. It is engaged and secured by a lock nut 186. Ribs 188 are integrally formed with the tubular handle 38. These ribs guide placement of the bolt 182 during fabrication and operate to cause rotation of the bolt upon mounting the handle 38 to the tool 20.

The housing member 28 similarly includes a hand gripping aperture 190 formed therein and is configured to abut against the frame member 22, to conform with the shape of the guard 62, and to space itself from the surface of frame member 22 for receiving the bearing support segment 58 of the frame member 22. The housing member 28 includes a plurality of recessed bores 198 (FIG. 5) having apertures formed therein and which are axially aligned with segments formed in the housing member 26. A plurality of screws 200 extend through the apertures of the bores 198, through aligned bores in the frame member 22 and engage the bores 202 of the housing member 26 to securely maintain the housing members 26 and 28 in assembly with the frame member 22. A plurality of screws 210 (FIG. 4) extend through the frame member 22 and engage the housing member 26 while screws 212 (FIG. 4) extend through the housing member 28 and engage the housing member 26 at the gripping handle area.

Figure 13:
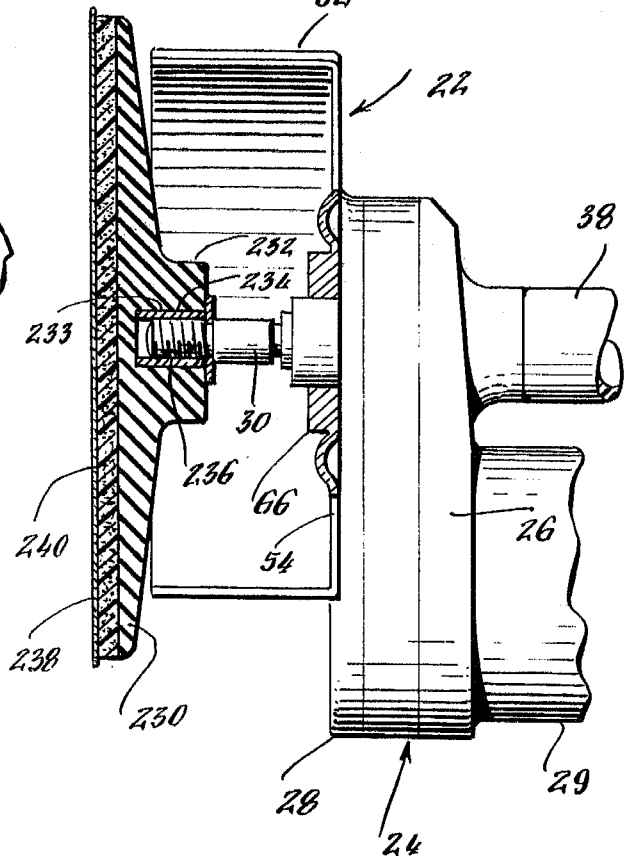
Figure 12:
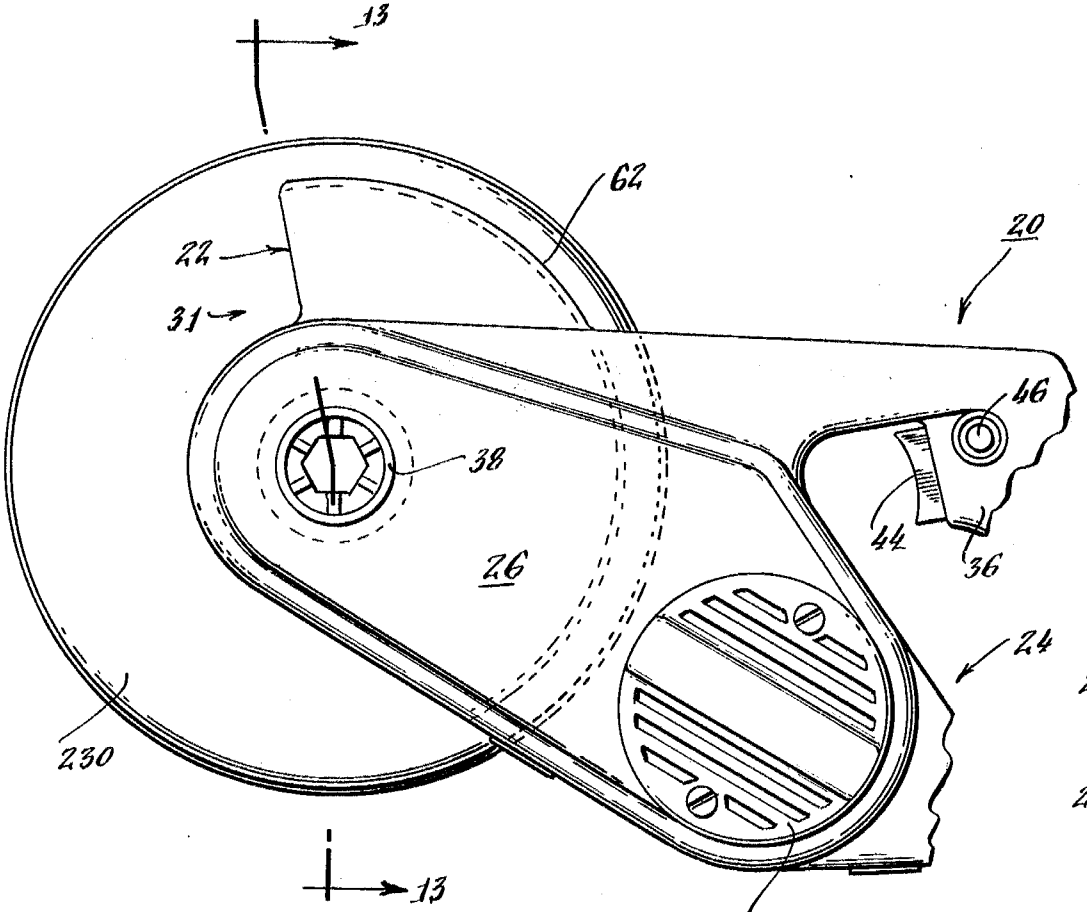
FIG. 12 is a fragmentary side view of the surface finishing device of FIG. 1 illustrating alternative use of a surface finishing device; and, FIG. 13 is a fragmentary view taken along lin 13—13 of FIG. 12.

In addition to employing the surface finishing tool 20 with peripheral acting finishing devices, the tool can also be usefully employed with a planar type of finishing device such as a sanding disc, a polishing bonnet, etc. FIGS. 12 and 13 illustrate a sanding disc assembly mounted to the tool. The sanding disc assembly includes a circular disc backing plate having an extended hub 232 with a centrally formed bore 233 having an internally threaded insert 234 molded therein for engaging the distal threaded segment 236 of the spindle 30. A pressure sensitive adhesive abrasive disc 238 is mounted against a lower surface of a foam body 240 which is secured by an adhesive to the backing plate 230.

Mounting and demounting of a finishing device is facilitated by initially restraining rotation of the spindle 30. A pin 251 (FIG. 4) is inserted in sequence through an aperture 253 in the housing member 26 (FIG. 1), through one of the apertures 255 in the pulley 110 and into a pocket 257 which is integrally formed in the member 22. Extension of the pin through these members inhibits rotation of the pulley and of the spindle which is coupled thereto.

As indicated hereinbefore, the relative positioning of the spindle and supported finishing device, the motor and the hand grips provide a balanced tool which exhibits enhanced ease of handling with different finishing operations. In a preferred embodiment of the housing members, field case, and handle grip are formed of a polymer plastic while the frame is formed of a light weight metal. Other materials may be utilized in fabricating these members to satisfy the desired weight, cost and operational characteristics.

Thus, an improved, and held, electrically operated, portable, surface finishing tool adapted for a multiplicity of finishing operations has been described. The tool is particularly advantageous in that its configuration provides for ease in handling and use. The speed-torque characteristics of the tool are selected to be advantageous with both peripheral and planar acting devices thus providing a means for driving a variety of different devices having desired finishing characteristics. In an examplary arrangement, the surface finishing tool provides a no load speed of 2700 or 3400 RPM. Since it is formed of relatively light weigh materials, it reduces the fatique accompanying the use of heavier portable hand held tools. The noise level is relatively quiet because of the provision of a belt drive and a relatively uniform finishing operation is accomplished because of the relatively higher speed with which the tool can be operated in comparison with the use of finishing devices with portable electric drills. The tool handling ease and its facility for use further enhance the characteristics of the finished surface.

While a particular embodiment of the invention has been described, it will be apparent to those skilled in the art that variations may be made thereto without departing from the spirit of the invention and the scope of the appended claims.

What is claimed is:

1. An improved, portable, electrically energized surface finishing tool adapted to be hand held and supported by a user during operation and to be maneuvered by the user for advancing a rotating, peripherally acting surface finishing tool into engagement with a workpiece, comprising:

a. an elongated, portable, tool body having a length, distal first and second opposite ends, and first and second sides thereof;

b. a first hand-gripping, tool support handle positioned adjacent said first end of the tool for providing manual support of said tool at said first end;

c. a support spindle, adapted to receive a peripherally acting surface finishing tool, positioned adjacent said second opposite end of the tool;

d. said spindle having first and second opposite ends thereof;

e. said spindle rotatably supported near a first end thereof and having said second spindle end unsupported and protruding from a side of said tool whereby a hub of a peripheral acting surface finishing tool can be positioned on said spindle from said second end;

f. said first handle and spindle mutually orientated for providing that said handle is positioned rearwardly of said spindle on said body and said spindle extends horizontally and transversely to said tool body length when said support handle is positioned vertically;

g. a second hand-gripping tool support handle positioned adjacent said spindle at said second end of said body for providing manual support of said tool adjacent said second end;

h. a guard means positioned between said spindle and said first support handle, said guard means configured to inhibit projection of workpiece particles from said second relatively forward end of said tool body to said first relatively rearward end at which position a user is located;

i. said guard means configured for enabling a periphery of a rotating surface finishing tool to be advanced into engagement with a workpiece upon advancement of the tool in directions generally parallel to the length of the body;

j. electric motor means protruding transversely from said second side of said tool body at a location rearwardly of said spindle and intermediate said spindle and first handle;

k. said motor means including an armature shaft having a longitudinal axis thereof extending transverse to the length of said tool body; and, l. a flexible coupling means extending in the direction of the length of said tool body for coupling said armature shaft and said spindle for imparting rotary action to said spindle.

2. The surface finishing tool of claim 1 wherein said second support handle comprises an elongated tubular shaped body which extends from the second side of the tool in a direction transverse to the length of the tool and generally parallel to said spindle.

3. The surface finishing tool of claim 2 wherein said second support handle is positioned opposite said spindle.

4. An improved, portable, hand held, electrically energized surface finishing tool adapted to be supported by a user and maneuvered about a workpiece during operation by the user comprising:

a. an elongated tool body havng a length and first and second sides thereof;

b. a spindle protruding from one side of said tool body and extending transverse to the length of said tool body;

c. said spindle positioned at a relatively forward end of said tool body and rotatably supported adjacent a distal segment of said spindle;

d. a peripherally acting surface finishing device mounted on said spindle for rotation in a direction parallel to said length;

e. a first tool hand-gripping means positioned at a relatively rearward end of the body, said tool gripping means including a handle extending in a direction parallel to said length;

f. a second tool hand-gripping means positioned at a relatively forward end of the body and extending from said second side in a direction transverse to said length;

g. guard means extending partly about said finishing device for inhibiting rearward projection of workpiece particles;

h. said guard means configured for enabling advan cement of the finishing device into engagement with a workpiece when the tool body is advanced in a first direction parallel to its length and in a second direction perpendicular to its length;

i. means including an electric motor having an armature thereof protruding from an opposite side of the body and extending transverse to said length and, j. belt coupling means extending between said armature and spindle in the direction of said tool body length for imparting rotary motion to said spindle.

5. The apparatus of claim 4 wherein said peripheral acting surface finishing device comprises a flap sanding device including a plurality of peripherally located, radially extending abrasive strips each backed by a resilient body and a hub for mounting said flap sanding device to said spindle and lock means for maintaining said flap sanding device on said spindle for rotary motion therewith.

6. An improved, portable, hand held, electrically energized, surface finishing tool adapted to be manually supported and maneuvered by a user about a workpiece during a finishing operation comprising:

a. an elongated tool body having a length and first and second sides thereof;

b. a tool spindle having first and second ends thereof;

c. said tool body having means for rotatably mounting said spindle at a relatively forward first end of the tool body and for mounting an electric motor at a location which is longitudinally spaced apart rearwardly from said spindle;

d. said spindle mounted at said first end thereof and protruding from the first side of said tool body in a direction transverse to said tool body length;

e. said motor having an armature shaft extending from said body in a direction transverse to the length of said body;

f. a means including a flexible drive belt extending in a direction of said body length for providing mechanical coupling between said armature shaft and said spindle whereby rotary motion of said armature shaft causes rotary motion of said spindle;

g. a first hand-gripping means integrally formed with said tool body and positioned at a first end of said tool body;

h. a second tubular shaped hand-gripping body positioned at a second end of said tool body;

i. an arc shaped guard means positioned between said spindle and said first hand-gripping means for inhibiting projection of workpiece particles from the rotating finishing device towards said first end of the tool body; and, j. said guard means configured for enabling advancement of the rotating tool into engagement with a workpiece when the tool body is advanced in the direction of its length and in a direction transverse to its length.

7. An improved, portable, hand held, electrically energized surface finishing tool comprising:

a. an elongated tool body having a frame member, and a housing formed by first and second housing members which are positioned about said frame member and enclose a part of the frame;

b. said tool body having a length and first and second sides thereof;

c. a spindle for supporting a peripherally acting finishing tool at one end of said tool said spindle having first and second ends thereof and protruding from said second side of said body;

d. a means for rotatably mounting said spindle to said frame at said first spindle end for supporting said spindle at said second side of said tool body in a direction transverse to said length of said tool body;

e. electric motor means having an armature shaft;

f. means for mounting said motor means to said frame member to provide extension of said armature shaft from said second side of said tool body in a direction transverse to the length of said tool body;

g. means providing mechanical coupling between said armature shaft and said spindle.

h. said mechanical coupling means positioned within the housing formed by said first and second housing members; and, i. said first and second housing members forming a saw grip support at an opposite end of said tool.

8. The surface finishing tool of claim 7 wherein said mechanical coupling means includes a belt drive.

9. The surface finishing tool of claim 7 wherein said spindle mounting means comprises a bearing support mounted to said frame member and said motor mounting means includes an armature shaft bearing, and means formed in said frame member for supporting said armature shaft bearing.

10. The surface finishing tool of claim 9 wherein said frame member includes a longitudinally extending surface segment, a motor bearing support segment for supporting said armature bearing, and a longitudinally extending segment for coupling said surface segment of said frame to said motor bearing support segment of said frame.

11. The surface finishing tool of claim 10 wherein said guard member is integrally formed with the frame member.

12. The surface finishing tool of claim 8 including a drive pulley coupled to said tool spindle, said drive belt is coupled to said armature shaft and pulley, and rotatable bearing block means for varying the relative position between an axis of said pulley and said armature shaft for varying the tension of said drive belt.

13. The drive means of claim 12 wherein said means for adjusting said relative position comprises a bearing block having a segment thereof extending transversely through said aperture at said first location and supporting said tool spindle at said first location, said bearing block having an eccentrically formed member and means for adjusting the rotary position of said bearing block for varying the tension on said drive belt.

14. The surface finishing tool of claim 7 wherein said housing members extend in the direction of said frame member, are positioned on opposite sides of said frame member, and are adapted to engage and conform to said frame member, and mounting means for mounting and engaging said first and second mounting members.

15. A surface finishing tool of claim 14 wherein said first and second housing members each include an aperture formed therein to provide a saw grip support handle.

16. The surface finishing tool of claim 15 wherein a first of said housing members extends substantially for the length of said frame member, said hand gripping apertures are formed at one end of said housing member, and means are provided at an opposite end of said housing member for mounting a second hand gripping member.

17. The surface finishing tool of claim 16 including means for mounting a tubular shaped transversely extending, hand gripping support member.

18. A portable, electrically energized surface finishing tool adapted to be hand held by a user and to be maneuvered into engagement with a workpiece, said tool including a spindle for rotatably mounting a peripherally acting finishing device at one end of the tool and hand grips for supporting the tool at opposite ends of the tool, said tool including an elongated frame member supporting said spindle at a single end of said spindle, said spindle extending from a first side of the frame member in a direction transverse to the length of said frame, said tool including an electric motor having a transversely extending armature shaft, bearing means for supporting said armature shaft on said frame, said shaft extending from a second side of said frame in a direction transverse to said frame, a guard means positioned between said spindle and said grips for inhibiting the projection of particles toward said second end of the tool, said guard means extending an arcuate distance about said spindle in a direction transverse to the length of said frame member from said first side of said frame.

19. A portable, electrically energized, surface finishing tool adapted to be hand held and supported by a user during operation and to be maneuvered by the user for advancing a rotating, peripherally acting surface finishing tool into engagement with a workpiece, said finishing tool including an elongated body having an elongated frame member and a support handle located at a relatively rearward end of the tool body, a spindle for rotatably mounting a peripherally acting finishing device at a relatively forward end of the tool body, said spindle supported at an end thereof by said frame member and protruding from a first side of the tool body, an electric motor including an elongated motor mounting field case protruding from a second opposite side of said tool body in a direction transverse to a length of said frame member at a location intermediate said handle and said spindle, means for mounting said motor mounting field case to said frame member and a coupling means including a drive belt extending in the direction of said tool body length for coupling said electric motor to said spindle for imparting rotary motion thereto.

20. The surface finishing tool of claim 19 wherein said motor includes an armature shaft, a bearing means supported in said field case for supporting a first distal segment of said armature shaft, a bearing means supported in said frame member for supporting a second distal segment of said armature shaft, and a motor cooling fan mounted on said armature shaft adjacent to frame member.

21. The surface finishing tool of claim 20 including a baffle means positioned adjacent said frame member and fan and extending into said field case for causing an air stream created upon rotation of said fan to flow between said armature and a field of said motor.

* * * * *